US006827655B2

(12) United States Patent
Burns

(10) Patent No.: US 6,827,655 B2
(45) Date of Patent: Dec. 7, 2004

(54) METHOD AND APPARATUS FOR PRACTICING PUTTING STROKE

(76) Inventor: Ronald S. Burns, P.O. Box 36868, Phoenix, AZ (US) 85067-6868

( * ) Notice: Subject to any disclaimer, the term of this patent is extended or adjusted under 35 U.S.C. 154(b) by 0 days.

(21) Appl. No.: 10/382,158

(22) Filed: Mar. 4, 2003

(65) Prior Publication Data

US 2004/0175682 A1 Sep. 9, 2004

(51) Int. Cl.[7] ..... A63B 69/36
(52) U.S. Cl. ..... 473/236
(58) Field of Search ..... 434/252; 473/251, 473/252, 256, 313, 340, 342, 236, 257, 261, 265, 242

(56) References Cited

U.S. PATENT DOCUMENTS 3,039,776 A * 6/1962 Faini ..... 473/236
3,194,564 A * 7/1965 Swan ..... 473/236
4,130,282 A * 12/1978 Pelz ..... 473/236
4,323,246 A * 4/1982 Nehrbas, Jr. ..... 473/236
5,011,153 A * 4/1991 Watkins ..... 473/236
5,135,229 A * 8/1992 Archer ..... 473/236
5,441,268 A * 8/1995 Shier ..... 473/236
5,478,078 A * 12/1995 Lee ..... 473/236
5,551,695 A * 9/1996 Wolk ..... 473/236
5,924,935 A * 7/1999 Prewitt ..... 473/236
5,961,392 A * 10/1999 Hillock et al. ..... 473/236
6,450,903 B1 * 9/2002 Tate ..... 473/406

* cited by examiner

*Primary Examiner*—Kurt Fernstrom
(74) *Attorney, Agent, or Firm*—Tod R. Nissle, P.C.

(57) ABSTRACT

Improvements are provided for a putter. The putter includes a club head. The improvements are removably mounted on the putter and facilitate the practice of a putting stroke in which the putter club head moves along a path of travel that is generally parallel to the ground.

7 Claims, 3 Drawing Sheets

METHOD AND APPARATUS FOR PRACTICING PUTTING STROKE

CROSS REFERENCE TO RELATED APPLICATIONS

N/A.

STATEMENT REGARDING FEDERALLY SPONSORED RESEARCH OR DEVELOPMENT

N/A.

INCORPORATION-BY-REFERENCE OF MATERIAL SUBMITTED ON A COMPACT DISC (See 37 CFR 1.52(e)(5) and MPEP 608.05

N/A.

BACKGROUND OF THE INVENTION (1) Field of the Invention

This invention pertains to a method and apparatus for practicing golf.

More particularly, this invention pertains to a method and apparatus for practicing a putting stroke.

In a further respect, the invention pertains to a method and apparatus for practicing a putting stroke in which during the back stroke the club head of the putter moves along a path of travel that is substantially parallel to the ground.

In another respect, the invention pertains to a method and apparatus for determining whether the bottom surface of the putter is parallel to the ground both during the pre-shot routine and during the actual putting stroke.

In still a further respect, the invention pertains to apparatus that is used to practice a putting stroke and that can be adjusted to tolerate less deviation by a golfer from the desired path of travel of the putter club head during a putting stroke.

(2) Description of Related Art Including Information Disclosed Under 37 CFR 1.97 and 1.98.

A wide variety of practice devices are available for use by golfers. One such practice device is specifically designed for putting and is described in U.S. Pat. No. 5,810,675 to Weathers. The Weathers training device removably attaches to the club head of a putter and includes a pair of cylindrical parallel guide posts 122 and 124 that are normal to and extend outwardly from the putting face of the putter club head. The Weathers training device is intended for use during a pendulum stroke in which the putter club head moves along an arcuate path of travel:

> "During a practice swing, the club head 112 may follow an arcuate path similar to that of a pendulum. Guide posts 122 and 124 are of such a length to ensure that the posts do not come into contact with the putting surface during the putting stroke." Col. 5, lines 61 to 65. See also Col.4, lines 37 to 41.

It is believed desirable during short putts to move the putter club head along a path of travel that is not arcuate, but instead that is generally parallel to the ground. Such a path of travel is believed to reduce the likelihood the putter will err because during a putting stroke that follows a relatively linear path of travel the golfer does not have to account for changes in the distance of the putter head from the ground and can better focus on gauging the speed of the putter head as it strikes a golf ball. During a short putt, the length of the backstroke is two feet or less.

Accordingly, it would be highly desirable to provide a method and apparatus to practice moving a putter club head along a path of travel that is generally parallel to the ground.

It would also be highly desirable to provide a practice device that enables a golfer to readily determine if the putter is tilted such that the bottom of the putter is not substantially parallel to the ground but rather is canted with respect to the ground.

Therefore, it is a principal object of the instant invention to provide an improved method and apparatus for practicing a putting stroke.

Another object of the invention is to provide an improved method and apparatus for determining whether during a putting stroke the putter club head is moving along a path of travel that is arcuate or that is generally parallel to the ground.

A further object of the invention is to provide an improved putting method and apparatus that permits the degree of difficulty in putting to be varied.

Another object of the invention is to provide an improved putting method and apparatus to determine whether the putter club head is square to the ground or is canted with respect to the ground.

BRIEF DESCRIPTION OF THE SEVERAL VIEWS OF THE DRAWING(S)

These and other, further and more specific objects and advantages of the invention will be apparent from the following detailed description of the invention, taken in conjunction with the drawings, in which.

BRIEF DESCRIPTION OF THE INVENTION

Figure 1:
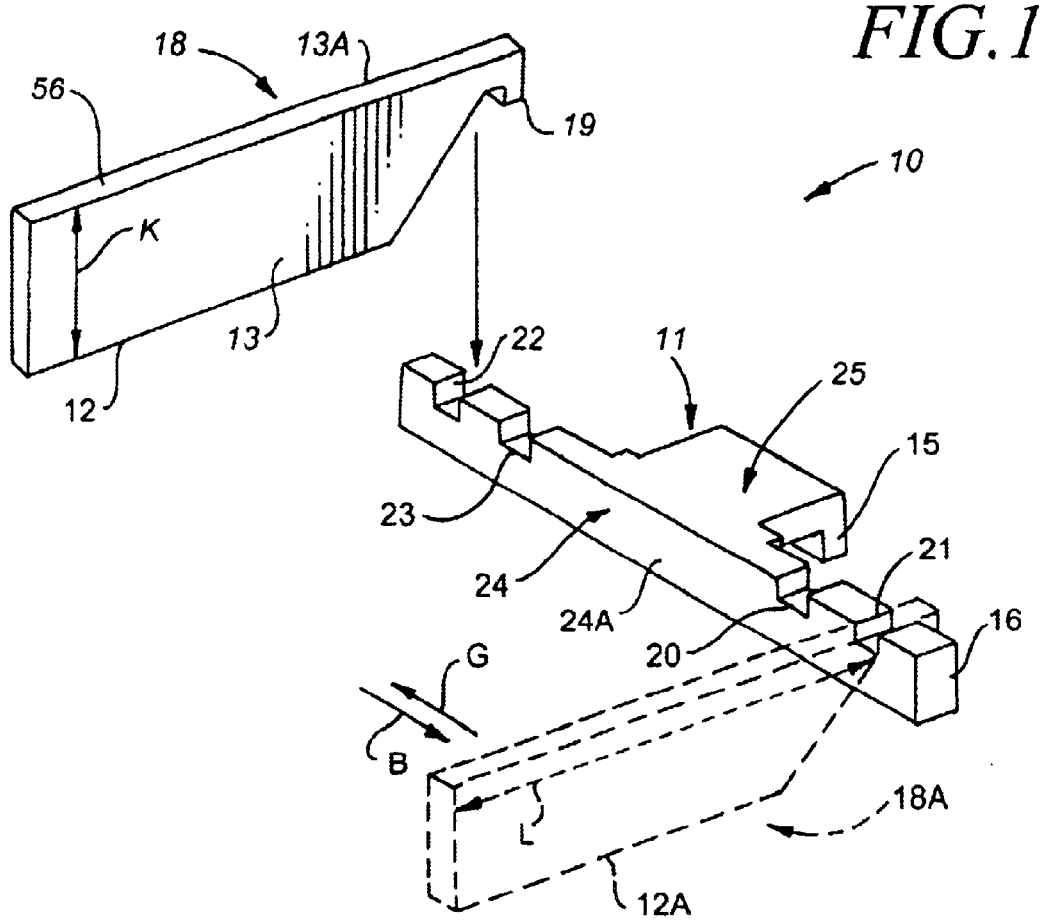
FIG. 1 is a perspective view illustrating a golf practice device constructed in accordance with the principles of the invention.

Briefly, in accordance with my invention, I provide improvements in combination with a putter. The putter has a club head, has a ball striking face, and has a bottom surface. The improvements enable practicing a putting stroke in which the club head moves along a path of travel substantially parallel to the ground during a backstroke. The improvements comprise a practice device. The practice device includes a body; a fastener connected to the body and removably securing the practice device to the club head; and, a pair of parallel spaced apart guide panels extending outwardly from the body normal to the ball striking face. Each of the panels has a lower edge positioned less than about one quarter inch above the ground when the bottom surface of the club head is resting on and substantially parallel to the ground.

In another embodiment of the invention, I provide an improved method for practicing putting using a putter having a club head having a ball striking face and having a bottom surface, the method facilitating a putting stroke in which during the backstroke the club head moves along a path of travel that is substantially parallel to the ground. The method includes the step of providing a practice device. The practice device includes a body; a fastener connected to the body to removably secure the practice device to the club head; and, a pair of parallel spaced apart guide panels extending outwardly from the body. Each of the panels has a lower edge. The method also includes the step of using the fastener to mount the practice device on the club head such that the guide panels and lower edges extend outwardly from and are perpendicular to the striking face; and, such that the lower edges of the panels are each less than about one-quarter inch from the ground when the bottom surface of the club head contacts and is substantially parallel to the ground. The method also includes the step of moving the putter through a backstroke while maintaining the lower edges spaced apart from and substantially parallel to the ground.

In a further embodiment of the invention, I provide improvements in combination with a putter. The putter has a club head, has a ball striking face, and has a bottom surface. The improvements enable practicing a putting stroke in which the bottom surface of the club head remains substantially parallel to the ground. The improvements comprise a practice device. The practice device includes a body; a fastener connected to the body and removably securing the practice device to the club head; and, a pair of parallel spaced apart guide panels extending outwardly from the body normal to the ball striking face. Each of the panels has a flat face at least one-half inch high and substantially normal to the ground and to the ball striking face to facilitate determining when the club head tilts such that the bottom surface is canted with respect to the ground.

In still another embodiment of the invention, I provide improvements in combination with a putter. The putter has a club head, has a ball striking face, and has a bottom surface. The improvements enable practicing a putting stroke in which the club head moves along a path of travel substantially parallel to the ground during a backstroke. The improvements comprise a practice device. The practice device comprises a body; a fastener connected to the body and removably securing the practice device to the club head; and, at least one guide panel extending outwardly from the body normal to the ball striking face. The panel has a lower edge. The practice device also comprises apparatus for adjusting the position of the guide panel laterally along the body in a direction parallel to the ball striking face while maintaining the guide panel normal to the ball striking face.

DETAILED DESCRIPTION OF THE INVENTION

Figure 2:
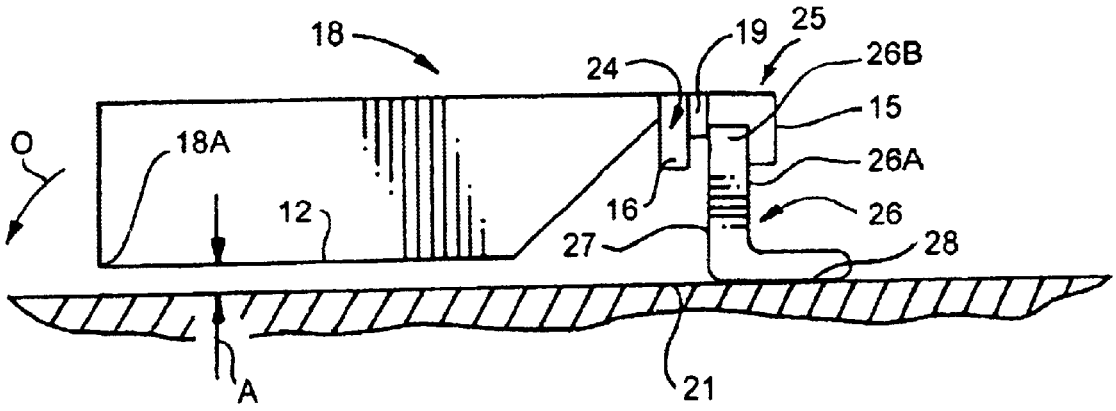
FIG. 2 is a side view of the device of FIG. 1 illustrating additional construction features thereof.
Figure 5:
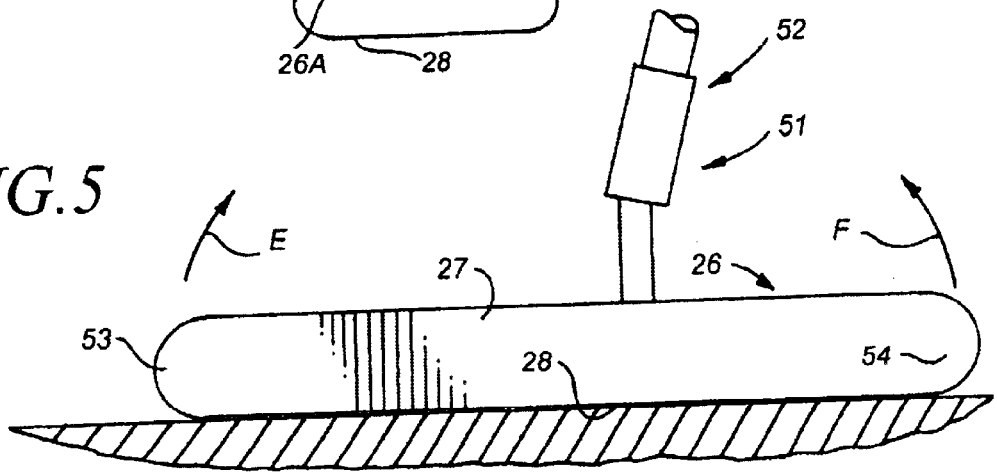
FIG. 5 is a front view of the club head of a putter illustrating the possible canting of the club head from its desired parallel orientation with respect to the ground; and, FIG. 6 is a top view of the panel members of the devices of FIGS. 1 to 4 illustrating the appearance thereof to a golfer setting up to putt.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate a practice device constructed in accordance with the invention and generally indicated by reference character 10. Practice device 10 includes support member 11 and guide panels 18. Member 11 includes elongate body 24 having face 24A. U-shaped notches 20 to 23 are formed in the top of body 24. L-shaped fastener 25 is attached to body 24. Fastener 25 functions to secure removably device 10 on the club head 26 of a putter 51 (FIG. 5). Fastener 25 includes arm 15 that extends downwardly over the back surface 26A of a club head 26 in the manner depicted in FIG. 2.

Each guide panel 18 includes top edge 56, bottom edge 12, opposed flat planar faces 13 and 13A, and arm 19. Arm 19 hooks or latches in a notch 20 to 23. After arm 19 latches in a notch 20 to 23, a panel 18 is oriented in the manner indicated by dashed lines 18A in FIG. 1. The length, indicated by dashed arrows L in FIG. 1, of panel 18 extending outwardly from face 24A can be varied as desired, but is presently at least two inches, preferably at least two and one-half inches, and most preferably at least three inches. The height, indicated by arrows K in FIG. 1, of a panel 18 can be varied as desired, but is presently at least one-half inch, preferably at least one inch, and most preferably at least one and one-half inches. The shape and dimension of face 13 can vary as desired, but face 13 is preferably has a flat, generally orthogonal shape. Incorporating a flat face 13 in a panel 18 is important because it facilitates a golfer's being able visually to discern when the club head of a putter is tilted such that the bottom of the putter is canted with respect to the ground and is not generally parallel to the ground. A flat face 13 in a panel 18 also facilitates a golfer's being able visually to discern when the club head 26 is pivoted about an axis that is perpendicular to the ground and such that the face 27 of the club head 26 is no longer normal to the desired direction of travel M (FIG. 6) of a golf ball.

FIG. 2 illustrates the practice device 10 after fastener 15 is used to hook or mount device 10 on the upper edge 26B of the club head 26 of a putter. When device 10 is mounted on club head 26, the distance A of lower edge 12 of a panel 18 above the ground can vary as desired, but presently is less than about one-half inch (i.e., is one-half inch plus or minus one-sixteenth of an inch), preferably is less than about three-eighths of an inch (i.e., is three-eighths inch plus or minus one-sixteenth of an inch), and most preferably is less than about one-quarter of an inch (i.e., is one-quarter of an inch plus or minus one-sixteenth of an inch). The short distance between lower edge 12 and the ground 21 is important because a critical function of panels 18 is to contact the ground 21 if a golfer on the back stroke fails to move the club head 26 along a path of travel that is generally parallel to the ground. If the golfer on the back stroke moves the putter head along an arcuate pendulum-like path of travel, the club head 26 and panel 18 will tilt in the direction of arrow O in FIG. 2 and distal tip 18A likely will contact the ground 21. When tip 18A contacts the ground, the golfer knows that club head 26 likely is not moving along a path of travel parallel to the ground. When the club head 26 during a short backstroke of two feet or less moves along a path of travel that is parallel and close (i.e., within about an inch) to the ground, the club head ordinarily will tilt less because the hands and wrists of the golfer must travel rearwardly with the handle of the putter in order to maintain the club head on a path of travel that is generally parallel to the ground. When the hands and wrists of the golfer travel rearwardly with the handle, there is less of a tendency for the golfer to use his wrists to "snap" or pivot the handle of the putter from back to front. Instead, there is more of a tendency for the golfer to keep during the back stroke (and during the forward stroke into contact with the golf ball) the position of his or her wrists and hands fixed with respect to the golfer's forearms. Keeping the hands, wrists, and forearms in a fixed configuration with respect to each other reduces the number of variables in the putting stroke, and is believed to facilitate a golfer's becoming a more consistent puffer. The practice device of the invention promotes this kind of putting stroke.

While it is an object of the practice device of the invention to practice moving the putter club head along a path of travel that is generally parallel to the ground, it is understood that there is a natural tendency to gradually increase the distance of the putter club head from the ground as the club head moves further and further into the backstroke. As long as the path of travel of the putter club head during the backstroke is at an angle to the ground of less than twenty degrees, preferably less than ten degrees, most preferably less than five degrees, the path of travel of the club head is deemed herein to be generally parallel to the ground.

Figure 3:
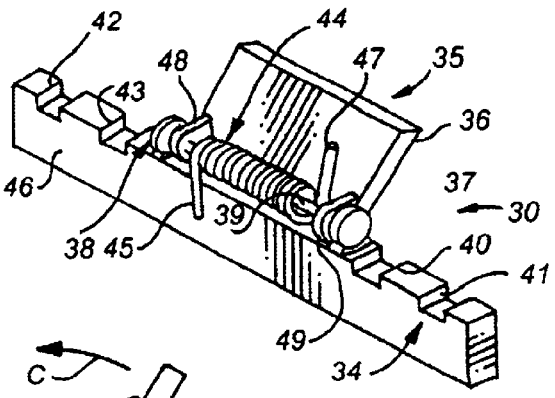
FIG. 3 is a perspective view illustrating another embodiment of the golf practice device of the invention.
Figure 4:
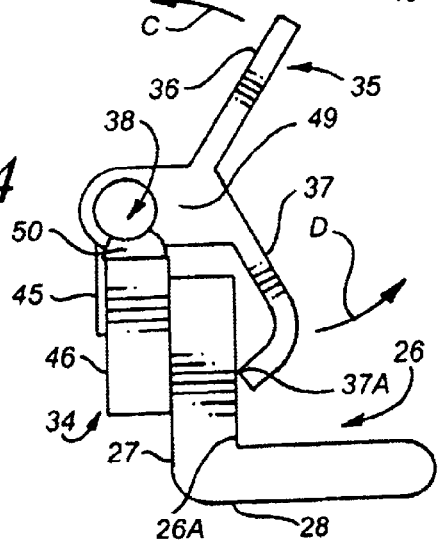
FIG. 4 is a side view of the device of FIG. 3 illustrating the mode of operation thereof.

Another embodiment of the invention is illustrated in FIGS. 3 and 4 and includes support member 30. Member 30 includes elongate body 34 having face 46. U-shaped notches 40 to 43 are formed in the top of body 34. Spring loaded fastener 35 is attached to the upper portion of body 34. Fastener 35 functions to secure removably device 30 on the club head 26 of a putter 51 (FIG. 4). Fastener 35 includes pin member 38 welded 50 or otherwise fixedly secured to the upper portion of body 34. Spring 44 is mounted on the elongate cylindrical shaft or neck 39 of member 38. One end 45 of spring 44 bears against face 46. The other end 47 of spring 44 bears against elongate rectangular tab 36 of fastener 35. Tab 36 is connected to spaced apart arms 48 and 49. Shaft 39 extends through apertures formed in arms 48 and 49. Arms 48 and 49 pivot about stationary shaft 39. Elongate tab 37 includes elongate end or edge 37A that bears against the back surface 26A of club head 26. Spring 44 functions to maintain fastener 35 in the configuration illustrated in FIG. 4. To remove device 30 from club head 26, the golfer displaces tab 36 in the direction of arrow C to cause end 37A to move away from surface 26A in the direction indicated by arrow D. Device 30 can then be lifted upwardly off club head 26. The reverse procedure is used to install device 30 on club head 26.

Panels 18 (not shown in FIGS. 3 and 4) are mounted in U-shaped notches 40 to 43 in the same manner panels 18 are mounted in notches 20 to 23 in FIG. 1. Notches 40 to 43 (and 20 to 23) permit the distance between a parallel opposing pair of panels 18 to be laterally adjusted in directions B, G parallel to face 27, 46. Placing one panel 18 in notch 42 and another panel in notch 41 produces a first distance between the panels 18. Placing one panel 18 in notch 43 and another panel in notch 40 produces a second distance between the panels 18 which is less than said first distance. The second smaller distance gives a golfer less room for error on the backstroke and forward stroke of the club head 26. The second distance between panels 18 is still, however, greater than the diameter of a golf ball 58 so that a golfer can use the face 27, 46 of a club head to contact a golf ball positioned between a parallel pair of panels 18 in the manner illustrated in FIG. 6. Other means can be utilized to alter the position of panels 18 on a body 24, 34. Panels 18 and body 24, 34 can, for example, be constructed such that panels 18 each slide laterally along the body 24, 34 between a plurality of different positions.

Figure 6:
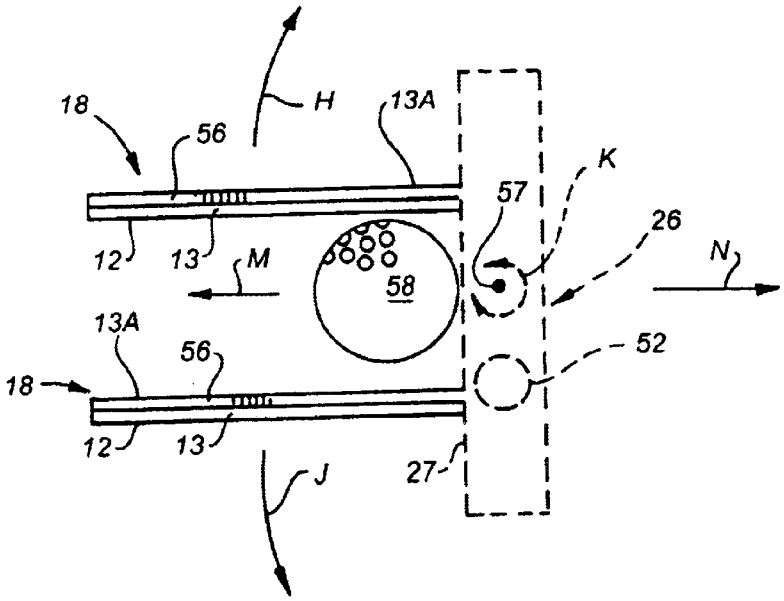
Figure 6:
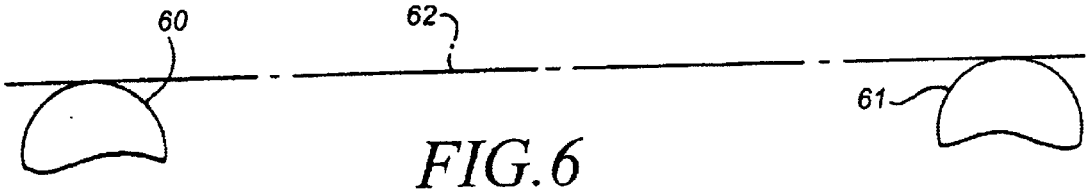

FIG. 6 illustrates in ghost outline a club head 26 connected to the shaft 52 of a putter 51. Dot 57 represents an axis that is perpendicular to the ground and to the plane of the sheet of paper on which FIG. 6 is drawn, and that is parallel to face 27 and faces 13. When putting, a golfer attempts to keep face 27 perpendicular to the desired path of travel M of ball 58 and to the desired path of travel N of the club head during the backstroke. Unfortunately, it is a simple matter for a golfer to pivot inadvertently club head 26 about vertical axis 57 in the direction of arrows H, J, K such that face 27 is no long perpendicular to the paths of travel M and N. Flat surfaces 13, as well as the length of panels 18, facilitate a golfer's being able to detect visually the unwanted rotation of club head 26 about axis 57 or about the axis coincident with or parallel to the longitudinal centerline of the shaft 52 on which club head 26 is mounted.

In FIG. 6, for sake of clarity, the support member 11, 30 is omitted, and only arms 18 are pictured in their normal configuration in which they are perpendicular to face 27, parallel to each other, and parallel to the ground. In use, a golfer positions his feet along a line 62 that is parallel to the desired path of travel of ball 58 when the ball is struck by and leaves face 27. If the golfer does not use his feet to define a line parallel to a desired line of travel, the golfer still "reads" a green and determines the desired line of travel indicated by arrow M. Once line 62 and the desired line of travel M are defined, the golfer positions club head 26 with face 27 normal to paths of travel M and N and with the bottom 28 of the club head parallel to the ground.

As indicated in FIG. 5, a golfer can inadvertently tilt the toe 53 of club head 26 in the direction of arrow E of the ground while maintaining the heel 54 in contact with the ground—or vice-versa. Such tilting or canting of the bottom 28 of the club head 26 with respect to the ground is not desirable. The length (i.e., greater than two inches) of panels 18 and the flat surfaces 13 facilitate a golfer's being able visually to determine when club head 26 is canted and to determine when the club head 26 is positioned properly with bottom 28 generally parallel to the ground.

Once a golfer achieves the position of club head 26 illustrated in FIG. 6 with bottom 28 generally parallel to the ground, the golfer moves his hands, wrists, and forearms simultaneously rearwardly in the direction of arrow N while maintaining the position of the hands, wrists, and forearms in a fixed orientation with respect to one another. The golfer attempts to maintain the club head 26 within about one inch or less of the ground while moving the putter head along a path of travel that is generally parallel to the ground. If the golfer excessively tilts the club head 26 and device 10 in the direction of arrow D in FIG. 2, then tips 18A contact the ground. When tips 18A contact the ground, the golfer knows that the putter head either followed an arcuate path of travel or was excessively tilted while moving along a path of travel parallel to the ground. The golfer adjusts the distance between parallel panels 18 to make the control required during his practice strokes more difficult (panels 18 closer together) or less difficult (panels 18 further apart).

If the golfer during his practice back strokes maintains the club head 26 along a path parallel to the ground without contacting the ground with tip 18, the golfer can attempt the forward stroke to contact ball 58. Panels 18 enable a golfer to visually determine if the club head proceeds along a desired path of travel M with panels 18 parallel to the desired path. Practice with device 10 is facilitated if writing on ball 58 (i.e., Titliest, Spalding, etc.) is aligned with the desired path of travel M of ball 58. The golfer can then visually better ascertain if during the swing of club head 26 the panels 18 are maintained parallel to the writing on ball 58.

Having described my invention in such terms as to enable those of skill in the art to make and practice it, and having described the presently preferred embodiments thereof, I claim:

1. In combination with a putter having a club head with a top, having a ball striking face, and having a bottom surface, the improvements for practicing a putting stroke in which the club head moves along a path of travel substantially parallel to the ground during a backstroke, said improvements comprising a practice device including (a) a body positioned in front of said ball striking face, said body having a top, said top of said body positioned above the top of the club head;

(b) a fastener connected to said body and removably securing the practice device to the club head;

(c) a pair of parallel spaced apart guide panels each having a length of at least two inches and a height of at least one-half inch and removably mounted on and extending outwardly from said body normal to the ball striking face, each of said panels having (i) an elongate lower edge generally parallel to and space above the ground less than a distance in the range consisting of seven-sixteenths of an inch to nine-sixteenths of an inch when the bottom surface of the club is resting on and substantially parallel to the ground, and (ii) an upper edge extending above the top of the club head.

2. In combination with a putter having a club head with a top, having a ball striking face, and having a bottom surface, the improvements for practicing a putting stroke in which the club head moves along a path of travel substantially parallel to the ground during a backstroke, said improvements comprising a practice device including (a) a body positioned in front of said ball striking face, said body having a top, said top of said body positioned above the top of the club head;

(b) a fastener connected to said body and removably securing the practice device to the club head; and, (c) a pair of parallel spaced apart guide panels each having an arm extending over and removably engaging said top of said body such that said arm and said panel can be laterally moved along said top of said body in a direction parallel to the ball striking face between at least two operative positions.

3. In combination with a putter having a club head with a top, having a ball striking face, having a back surface, and having a bottom surface, the improvements for practicing a putting stroke in which the club head moves along a path of travel substantially parallel to the ground during a backstroke, said improvements comprising a practice device including (a) a body positioned in front of said ball striking face, said body having a top (b) an arm extending downwardly over the back surface;

(c) a spring-loaded fastener connected to said body and said arm and compressing said body against said ball striking face and said arm against the back surface to removably secure the practice device to the club head; and, (d) a pair of parallel spaced apart guide panels removably mounted on said body.

4. In combination with a putter having a club head with a top, having a ball striking face, and having a bottom surface, the improvements for practicing a putting stroke in which the club head moves along a path of travel substantially parallel to the ground during a backstroke, said improvements comprising a practice device including (a) a body positioned in front of said ball striking face, said body having a top with at least one notch formed therein, said top of said body extending above the top of the club head and generally parallel to the ball striking face of the club head;

(b) a fastener connected to said body and removably securing the practice device to the club head; and, (c) at least one guide panel having a length of more than two inches and extending outwardly from said body normal to the ball striking face, said panel having an arm shaped and dimensioned to removably engage said notch.

5. The combination of claim 4 herein said top of said body includes a plurality of notches and said arm of said panel is shaped and dimensioned to removably engage each of said notches such that moving said arm from one notch to another laterally moves said panel along said body in a direction parallel to the ball striking face while maintaining said panel normal to the ball striking face.

6. The combination of claim 5 at least one other guide panel, each of said guide panels having (i) a length of more than two inches, (ii) extending outwardly from said body normal to the ball striking face, (iii) an elongate generally straight lower edge positioned above the ground less than a distance in the range consisting of three-sixteenths of an inch to five-sixteenths of an inch when the bottom surface of the club is resting on and substantially parallel to the ground, and (iv) an upper edge extending above the top of the club head.

7. The combination of claim 6 including (a) a support arm extending downwardly over the back surface; and, (b) a spring-loaded fastener connected to said body and said support arm and compressing said body against said ball striking face and said support arm against the back surface to removably secure the practice device to the club head.

* * * * *